US006279761B1

(12) United States Patent
Niewiadomski et al.

(10) Patent No.: US 6,279,761 B1
(45) **Date of Patent: *Aug. 28, 2001**

(54) INFORMATION DISPLAY SYSTEM

(75) Inventors: Mitchell Niewiadomski, Lowell; Mark A. Baloga; Carl V. Forslund, III, both of East Grand Rapids, all of MI (US)

(73) Assignee: Steelcase Development Inc., Caledonia, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/260,474

(22) Filed: Mar. 1, 1999

(51) Int. Cl.[7] ..... A47F 5/08

(52) U.S. Cl. ..... 211/94.01; 211/96; 211/116; 211/169

(58) Field of Search ..... 211/94.01, 113, 211/45–48, 169, 96, 97, 119.004, 116; 312/245–248; 108/106–108; 52/105, 239, 243.1

(56) References Cited

U.S. PATENT DOCUMENTS

| | | | |
|---|---|---|---|
| 119,054 | 9/1871 | Shryock . | |
| 241,600 | 5/1881 | Bray | 119/412 |
| 241,925 | 5/1881 | Cadwell . | |
| 249,198 | 11/1881 | Moon . | |
| 253,538 | 2/1882 | McLane . | |
| 454,844 | 6/1891 | Brewerton et al. | 40/492 |
| 475,126 | 5/1892 | Lorenz . | |
| 549,347 | 11/1895 | Clark . | |
| 605,148 | 6/1898 | Sylvester . | |
| 621,835 | 3/1899 | MacDonald | 211/46 |
| 627,396 | 6/1899 | Daly . | |

(List continued on next page.)

FOREIGN PATENT DOCUMENTS

| | | | |
|---|---|---|---|
| 164466 | 4/1949 | (AT) . | |
| 232680 | 3/1964 | (DE) . | |
| 1 561 580 | 4/1970 | (DE) . | |
| 124334 | 4/1949 | (GB) . | |
| 3-93944 | 4/1991 | (JP) . | |
| 3-93946 | 4/1991 | (JP) . | |
| 4222787 | 8/1992 | (JP) | 52/239 |
| WO 95/24031 | 9/1995 | (WO) . | |

OTHER PUBLICATIONS

European Search Report for European Appln. No. EP 99 25 0383; search completed Oct. 4, 2000 by Examiner A. Puhl, 2 pages.

Yates, JoAnne, "Graphic ROI Reporting," Knowledge Management at 106, Oct. 1998.

Promotional materials for "A World of Possibilities. Introducing Contrada™. The Next Generation in Office Furniture.", by Trendway Corporation of Holland, Michigan, bearing a designation "©1998".

(List continued on next page.)

*Primary Examiner*—Daniel P. Stodola
*Assistant Examiner*—Jennifer E. Novosad
(74) *Attorney, Agent, or Firm*—Foley & Lardner

(57) ABSTRACT

The information display system includes a base assembly adapted to attach to a mounting structure and a plurality of display panels coupled to the track system for movement with respect to the mounting structure. The display panels are adapted to present information selectively for display by pivotal and translating movement of the plurality of display panels. The track system may include at least one rail. The display panels may be cantilevered away from the track system at a vertical elevation to provide clearance below the display panels for a seated worker. A container may be adapted for coupling to the track system. The container may provide at least one display panel adapted to reveal or conceal information.

79 Claims, 8 Drawing Sheets

U.S. PATENT DOCUMENTS

| | | | |
|---|---|---|---|
| 713,417 | 11/1902 | Feldmann et al. . | |
| 821,144 | 5/1906 | Walsh . | |
| 943,821 | 12/1909 | Feldmann, Jr. . | |
| 950,006 | 2/1910 | McCarty . | |
| 955,586 | 4/1910 | Emerich . | |
| 997,866 | 7/1911 | Smith | 211/1.51 |
| 1,086,236 | 2/1914 | Staples | 211/169.1 |
| 1,116,484 | 11/1914 | Ralph . | |
| 1,122,926 | 12/1914 | Hick | 211/169.1 |
| 1,141,404 | 6/1915 | Moseley | 211/169.1 |
| 1,203,659 | 11/1916 | Smith . | |
| 1,254,036 | 1/1918 | Grant . | |
| 1,326,832 | 12/1919 | Baily . | |
| 1,457,990 | 6/1923 | Morgan . | |
| 1,599,888 | 9/1926 | Haskell . | |
| 1,616,897 | 2/1927 | Hayes | 40/398 |
| 1,688,456 | 10/1928 | Dolph . | |
| 1,770,755 | 7/1930 | Kleinpell . | |
| 1,826,469 | 10/1931 | Hunt et al. . | |
| 1,881,636 | 10/1932 | Johnson et al. . | |
| 1,887,539 | 11/1932 | Brown | 211/48 |
| 1,943,629 | 1/1934 | Schwartz | 20/40.4 |
| 1,958,579 | 5/1934 | Johnson et al. | 35/15 |
| 1,997,829 | 4/1935 | McKee . | |
| 2,070,408 | 2/1937 | Leidgen | 211/96 |
| 2,144,083 | 1/1939 | Rentfrow, Sr. | 155/124 |
| 2,348,414 | 5/1944 | Pierce . | |
| 2,691,238 | 10/1954 | Svatos . | |
| 2,812,067 | 11/1957 | Gussack | 211/46 |
| 2,870,459 | 1/1959 | Zabielski | 5/2 |
| 2,886,182 | 5/1959 | Dauman . | |
| 2,914,873 | 12/1959 | Brennan . | |
| 2,928,555 | 3/1960 | Childs et al. | 211/169 |
| 2,963,332 | 12/1960 | Breuning | 312/231 |
| 3,017,999 | 1/1962 | Cano | 211/40 |
| 3,042,978 | 7/1962 | Eames et al. . | |
| 3,060,521 | 10/1962 | Greco | 52/65 |
| 3,078,133 | 2/1963 | Schauer | 312/223 |
| 3,141,207 | 7/1964 | Kahler . | |
| 3,181,274 | 5/1965 | Izenour | 50/24 |
| 3,251,477 | 5/1966 | Parstorfer | 211/169 |
| 3,286,382 | 11/1966 | Newman | 40/102 |
| 3,351,211 | 11/1967 | Best | 211/169 |
| 3,391,795 | 7/1968 | Cross . | |
| 3,391,796 | 7/1968 | Cross | 211/169 |
| 3,412,868 | 11/1968 | Carter . | |
| 3,425,568 | 2/1969 | Albright | 211/87 |
| 3,514,883 | 6/1970 | Albright | 40/67 |
| 3,557,499 | 1/1971 | Dickie et al. | 52/36 |
| 3,581,423 | 6/1971 | Mascolo . | |
| 3,683,100 | 8/1972 | Deal et al. . | |
| 3,732,633 | 5/1973 | Margolis et al. | 35/55 |
| 3,760,952 | 9/1973 | White | 211/168 |
| 3,777,896 | 12/1973 | Ehrlich | 211/49 D |
| 3,797,146 | 3/1974 | Holes . | |
| 3,857,731 | 12/1974 | Merrill, Jr. et al. . | |
| 3,883,972 | 5/1975 | Propst et al. . | |
| 3,921,320 | 11/1975 | McWilliams | 40/32 |
| 3,924,749 | 12/1975 | Weston | 211/4 |
| 3,952,133 | 4/1976 | Amos et al. . | |
| 3,975,837 | 8/1976 | Baars . | |
| 3,984,930 | 10/1976 | Booland | 40/65 |
| 4,033,058 | 7/1977 | Lyman | 40/97 |
| 4,135,775 | 1/1979 | Driscoll | 339/22 R |
| 4,166,332 | 9/1979 | Donovan . | |
| 4,180,298 | 12/1979 | Borgerson, Jr. | 312/242 |
| 4,194,313 | 3/1980 | Downing . | |
| 4,239,170 | 12/1980 | Planebo . | |
| 4,270,290 | 6/1981 | Eckert | 40/389 |
| 4,310,978 | 1/1982 | Stern . | |
| 4,360,240 | 11/1982 | Koncelik et al. . | |
| 4,360,991 | 11/1982 | West | 52/29 |
| 4,428,136 | 1/1984 | Franklin | 40/605 |
| 4,447,973 | 5/1984 | Wihlke . | |
| 4,457,436 * | 7/1984 | Kelley | 312/246 |
| 4,478,467 | 10/1984 | Tyndall | 312/250 |
| 4,569,448 | 2/1986 | Graham | 211/74 |
| 4,588,190 | 5/1986 | Stewart et al. | 473/435 |
| 4,606,394 * | 8/1986 | Bannister | 52/239 |
| 4,620,635 | 11/1986 | Morand | 211/47 |
| 4,652,239 | 3/1987 | Brimberg . | |
| 4,658,966 | 4/1987 | Broek | 211/46 |
| 4,715,154 | 12/1987 | Baloga | 52/239 |
| 4,723,665 | 2/1988 | Benedict et al. | 211/168 |
| 4,723,821 | 2/1988 | Montgomery . | |
| 4,750,305 * | 6/1988 | Bastian | 52/239 |
| 4,757,901 | 7/1988 | Woods . | |
| 4,771,557 | 9/1988 | Bowman . | |
| 4,793,495 | 12/1988 | Preu . | |
| 4,805,331 | 2/1989 | Boggess et al. | 40/651 |
| 4,902,229 | 2/1990 | Pedersen et al. . | |
| 4,913,297 | 4/1990 | Wells | 211/96 |
| 4,928,465 | 5/1990 | Del Castillo Von Haucke | 52/239 |
| 4,954,382 | 9/1990 | Riefler et al. . | |
| 4,979,785 | 12/1990 | Richards | 312/201 |
| 4,996,110 | 2/1991 | Tanuma et al. . | |
| 5,016,373 | 5/1991 | Theno . | |
| 5,090,171 | 2/1992 | Kano et al. . | |
| 5,105,952 | 4/1992 | Krattiger . | |
| 5,109,994 | 5/1992 | Kidd et al. | 211/162 |
| 5,112,020 | 5/1992 | Ginsberg . | |
| 5,125,202 | 6/1992 | Kissinger | 52/239 |
| 5,139,155 | 8/1992 | Laxson | 211/169 |
| 5,148,925 | 9/1992 | Althoff et al. . | |
| 5,160,050 * | 11/1992 | Russo | 211/96 |
| 5,160,189 | 11/1992 | Johnston et al. | 312/201 |
| 5,161,321 | 11/1992 | Kuhnke . | |
| 5,181,334 | 1/1993 | Mima | 40/524 |
| 5,186,499 | 2/1993 | Mason . | |
| 5,214,885 | 6/1993 | Maas et al. | 52/71 |
| 5,226,548 | 7/1993 | Koeppel | 211/144 |
| 5,241,796 | 9/1993 | Hellwig et al. | 52/36.4 |
| 5,248,536 | 9/1993 | Du Katz . | |
| 5,282,341 | 2/1994 | Baloga et al. | 52/32 |
| 5,289,926 | 3/1994 | Lewis et al. . | |
| 5,290,002 | 3/1994 | Cohen . | |
| 5,309,686 | 5/1994 | Underwood et al. | 52/29 |
| 5,321,579 | 6/1994 | Brown et al. | 361/681 |
| 5,342,665 | 8/1994 | Krawitz . | |
| 5,368,486 | 11/1994 | Kurzman . | |
| 5,375,802 | 12/1994 | Branham, II | 248/231.4 |
| 5,384,999 | 1/1995 | Roche et al. . | |
| 5,392,934 | 2/1995 | Fox | 211/94 |
| 5,394,631 | 3/1995 | Bosio | 40/491 |
| 5,406,761 | 4/1995 | Hobbiebrunken et al. . | |
| 5,422,155 | 6/1995 | Spence, Jr. . | |
| 5,428,928 | 7/1995 | Hellwig et al. | 52/239 |
| 5,486,391 | 1/1996 | Tyner . | |
| 5,495,953 | 3/1996 | Bearth | 211/40 |
| 5,503,278 | 4/1996 | Ishmael | 211/169 |
| 5,511,348 | 4/1996 | Cornell et al. | 52/239 |
| 5,513,574 | 5/1996 | Collins | 108/36 |
| 5,536,080 | 7/1996 | Madimenos et al. | 312/317.1 |
| 5,549,267 | 8/1996 | Armbruster et al. . | |
| 5,558,418 | 9/1996 | Lambright et al. | 312/321.5 |
| 5,569,503 | 10/1996 | Piotroski . | |
| 5,584,546 | 12/1996 | Gurin et al. | 312/200 |
| 5,588,659 | 12/1996 | Boes et al. | 280/47.19 |
| 5,590,940 * | 1/1997 | Richard | 312/246 |
| 5,607,214 | 3/1997 | Pierce et al. | 312/310 |
| 5,609,112 | 3/1997 | Meyer et al. | 108/153 |

| | | | | |
|---|---|---|---|---|
| 5,617,660 | | 4/1997 | Pollack . | |
| 5,635,265 | | 6/1997 | Potokar . | |
| 5,647,172 | | 7/1997 | Rokicki | 49/504 |
| 5,649,631 | | 7/1997 | Loflin | 211/44 |
| 5,655,323 | | 8/1997 | Lassoff . | |
| 5,655,672 | | 8/1997 | Stuchlik, III | 211/70.7 |
| 5,658,635 | | 8/1997 | Davis et al. . | |
| 5,675,946 | * | 10/1997 | Verbeek et al. | 52/239 |
| 5,687,499 | | 11/1997 | Brnjac | 40/524 |
| 5,687,513 | | 11/1997 | Baloga et al. | 52/32 |
| 5,688,579 | | 11/1997 | Konsti et al. . | |
| 5,695,264 | | 12/1997 | Koch | 312/310 |
| 5,697,589 | | 12/1997 | Garfinkle | 248/223.41 |
| 5,711,121 | | 1/1998 | Garver | 52/239 |
| 5,724,778 | | 3/1998 | Cornell et al. | 52/239 |
| 5,743,193 | | 4/1998 | Kakuta et al. | 108/147 |
| 5,746,330 | | 5/1998 | DiBetta | 211/70.6 |
| 5,765,315 | | 6/1998 | Nagamitsu et al. | 52/36.1 |
| 5,771,954 | | 6/1998 | Benner et al. . | |
| 5,826,385 | | 10/1998 | Dykstra et al. | 52/220.7 |
| 5,826,639 | | 10/1998 | Miller | 160/135 |
| 5,829,202 | | 11/1998 | Gongora et al. | 52/36.1 |
| 5,831,211 | | 11/1998 | Gartung et al. | 174/48 |
| 5,848,698 | | 12/1998 | Stompe | 206/449 |
| 5,873,205 | | 2/1999 | Hanlon et al. | 52/239 |
| 5,913,787 | | 6/1999 | Edwards | 52/220.7 |
| 5,931,429 | * | 8/1999 | Hellwig et al. | 108/108 |
| 5,966,879 | | 10/1999 | Verbeek et al. | 52/205 |
| 5,984,441 | | 11/1999 | Stokhuijzen | 312/240 |
| 6,048,044 | | 4/2000 | Biggel et al. . | |

OTHER PUBLICATIONS

Advertisement for "Ameriwood Oak Armoire", by Office Max, bearing a designation "Nov. 11, 1995", 1 sheet.

Promotional material (chart) by Dowing Displays of Milford, Ohio, showing display models (no date), color.

Brochure for "TooGo New Workplace Solutions", by Egan Visual, bearing a designation "©Copyright Eagan Visual 1999", 16 color sheets.

Promotional material for "The Office of the Future", by Tarrant Interiors—of Fort Worth, Texas, (no date), 4 sheets.

Innamorati, Francesco, "The Telematic Tree", Habitat Ufficio, bearing a designation 1991.

Promotional material for "Village Wall," by Tellus Furniture a Paoli Company of Orleans, Indianna, bearing a designation "©1998 Tellus Furniture", 8 color sheets.

Gertsakis, John, "*Durable Yet Future Proof*", bearing a designation"©1996, National Key Centre for Design at RMIT", 4 sheets, printed from Internet site: www.cfd.rmit-.edu.au/outcomes/erdnews/ERD6/HOTdesk.html on Oct. 27, 1998.

Brochure by UNIFOR titled "Pannelli PL" (undated) (37 sheets).

Brochure by UNIFOR titled "Progetto 25.90" (undated) (19 sheets).

* cited by examiner

FIG. 3
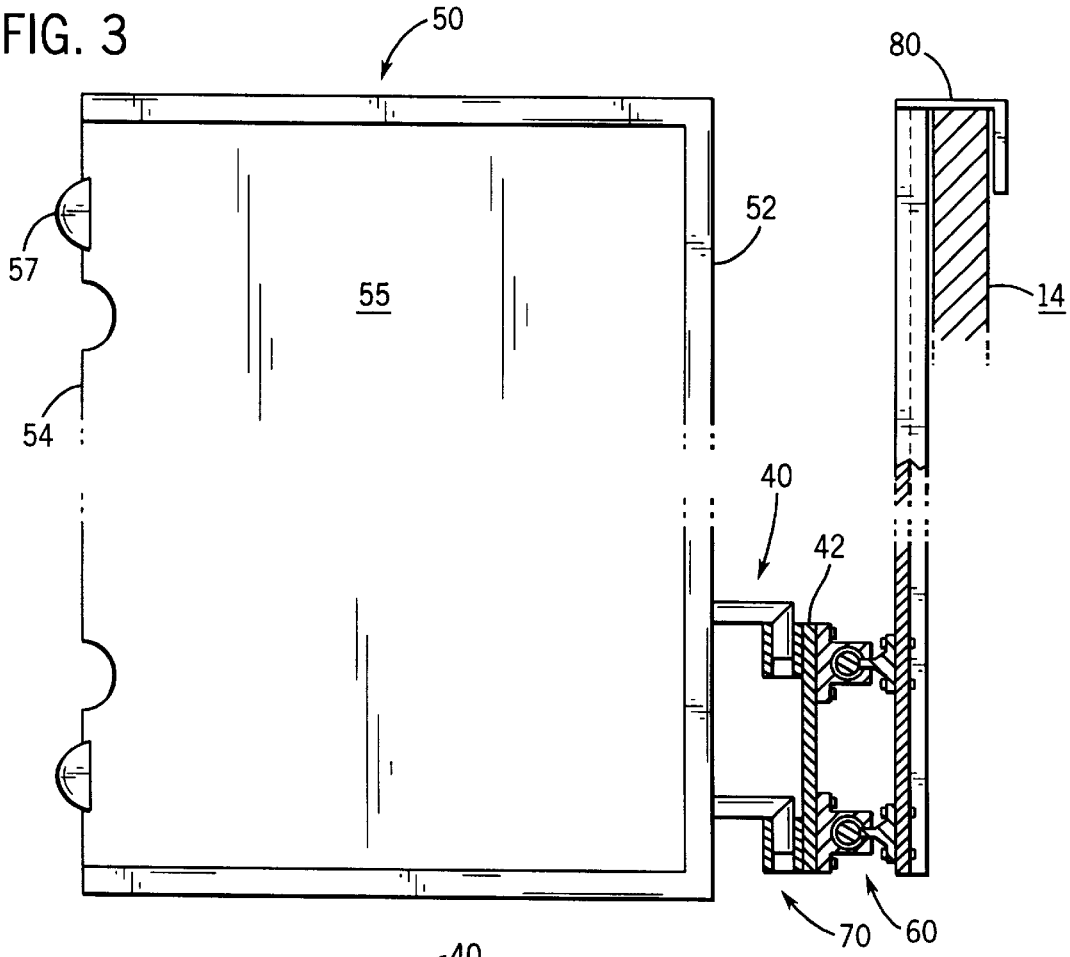
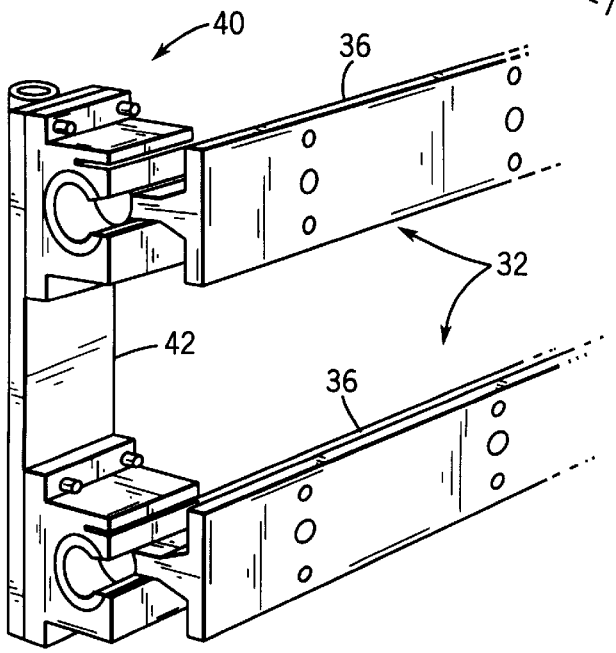
FIG. 4A

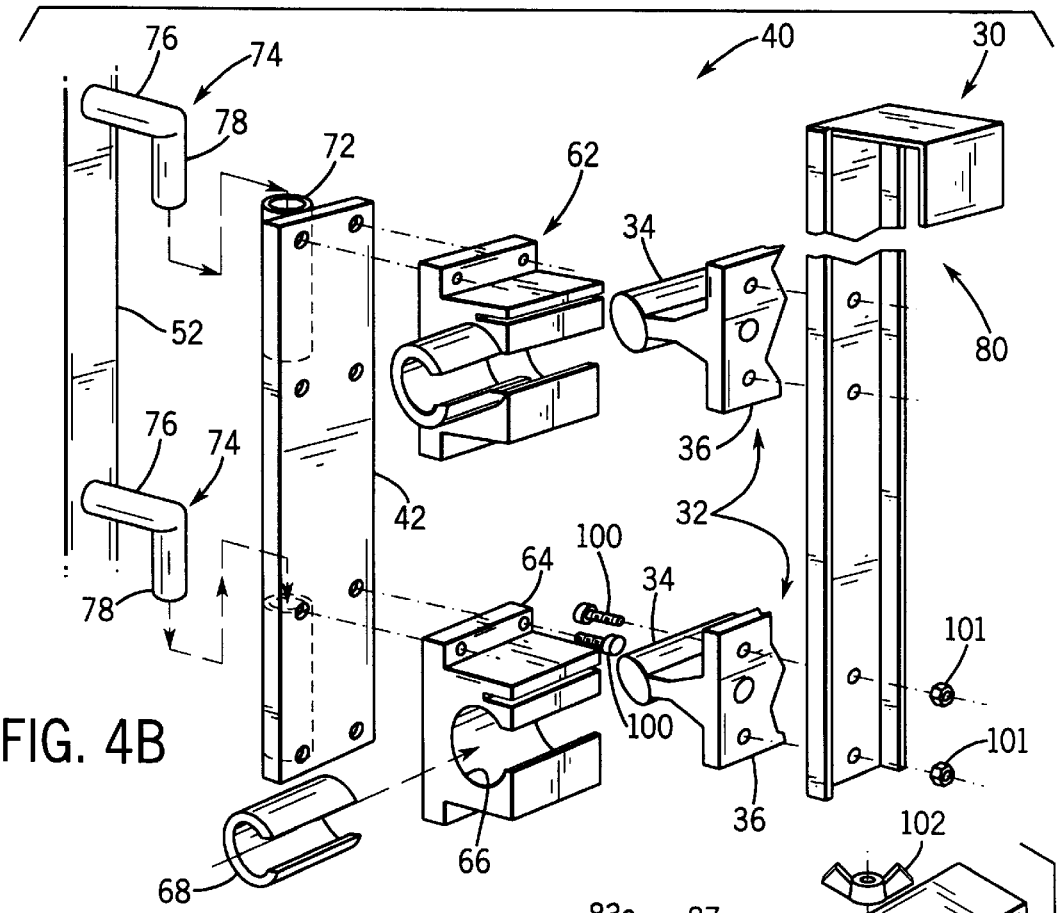
FIG. 4B
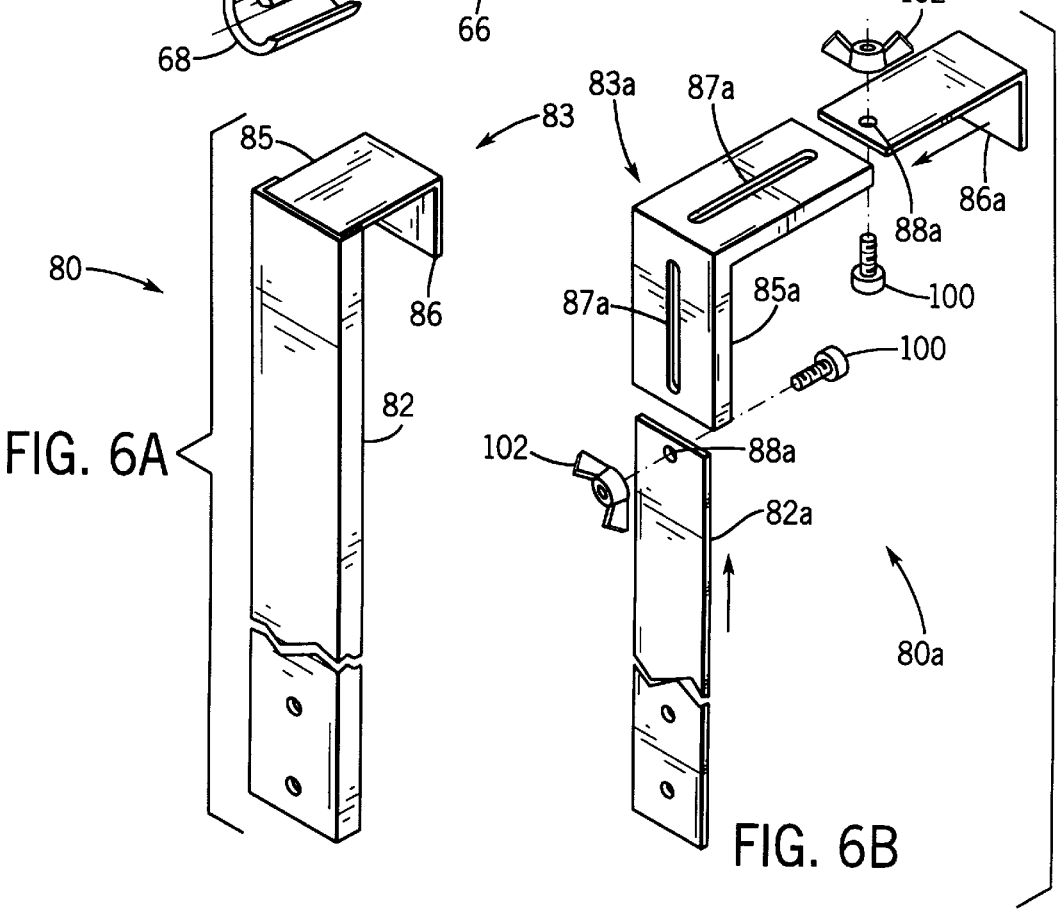
FIG. 6A
FIG. 6B

INFORMATION DISPLAY SYSTEM

FIELD OF THE INVENTION

The present invention relates to an information display system adapted for use within a work environment.

CROSS-REFERENCE TO RELATED APPLICATIONS

The following U.S. patent applications are cited by reference and incorporated by reference herein: (a) Ser. No. 09/182,998, titled "INFORMATION DISPLAY SYSTEM" and filed on Oct. 30, 1998; (b) Ser. No. 09/183,023, titled "WORK STATION" and filed on Oct. 30, 1998; (c) Ser. No. 09/183,021, titled "WORK ENVIRONMENT" and filed on Oct. 30, 1998; (d) Ser. No. 09/182,997, titled "DISPLAY BOARD SYSTEM" and filed on Oct. 30, 1998; (e) Ser. No. 09/182,999, titled "DISPLAY BOARD SYSTEM" and filed on Oct. 30, 1998.

BACKGROUND OF THE INVENTION

It is well known in a large work environment to define a group work space that may be divided or otherwise arranged to create one or more work areas for use by individual workers or small groups of workers. Work areas are commonly configured to form one or more workstations, by arrangement of one or more articles of furniture, such as panel walls, worksurfaces, storage units, chairs or seating products, etc., typically in a manner intended to support workers in a wide variety of individual and group activities. Typically, such known arrangements are not optimally suited for use in a dynamic work environment, where individual and team spaces are ideally capable of rapid configuration and reconfiguration by the workers themselves in a highly efficient manner, as needed for varied sets of individual or group activities. Recently, these dynamic work environments characterized by the need for flexibility, reconfigurable work areas, and the ability to support a wide variety of activities of both individual workers and project teams of varying sizes, have become prevalent and typically include more mobile forms of such articles of furniture.

All of these work spaces typically are required to accommodate a flow of information, often presented in the form of documents, that are created, used or shared by the workers. Indeed, in known work environments, it is well known to provide for the display of information to support the individual or collaborative activities of one or more workers. A fundamental purpose of any system for the display of information is to facilitate "information persistence"—to provide an organizational framework for the presentation of information that freely enables the collection of information, the presentation of information, and the retention of information as it becomes meaningful or useful to an individual or group. This purpose is best served by a system that allows current information to be prominently displayed and readily accessible. However, known arrangements for the display of information in any work environment, which typically utilize both vertical surfaces and horizontal surfaces provided within the work environment, do not fully achieve this or other purposes that are desirable. This is particularly true in a dynamic work environment.

In some typical work environments it is very common to display information on "fixed" or "static" vertical surfaces, such as full-height walls, partial-height panel walls, or the like. Fixed walls typically provide for the territorial division of the work space, and incidentally provide a stable vertical surface for the prominent display of information (e.g. space for "tiling" of information). However, because the amount of vertical wall surfaces available for use to display information is limited, the volume of information that can be displayed is limited. Moreover, fixed walls are not readily reconfigurable to form work areas since reconfiguration of the work space is generally a time-consuming and labor-intensive process beyond the capability of the workers themselves and requiring a substantial amount of advance planning and the use of tools and other equipment. Because fixed walls are effectively immobile and are not typically positioned for the display of information, their efficiency is further limited. In addition, the commonly known methods of presenting information on fixed walls of such known arrangements, for example, do not provide an organizational framework well suited to achieve an optimal degree of information persistence. In many instances, according to commonly known arrangements, the visual effect or "scenery" provided in the work environment by information displayed on vertical walls and surfaces tends to be static and constantly "on display," rarely being refreshed or interchanged for example, when placing charts in relatively inaccessible locations. In other instances, manner in which the information displayed on the vertical surface renders it fleeting and easily defaced, for example when information is written on a white board. That is, fixed walls are not able to adequately achieve optimum "information persistence" attributes, or to support the reconfigurability necessary in a dynamic work environment.

It is also very common to display and store information on horizontal surfaces, such as provided by desks, tables, shelving units or the like, in stacks or piles. However, given that the amount of horizontal surfaces in a work environment is limited, such information is commonly "stacked" or covered with other information, with other information given precedence—intentionally or inadvertently—over the information beneath it. As layers of information are created on the horizontal surface, it is common for workers to adopt a practice where the information is brought into view from beneath other information only as it is needed. While information presented in this fashion is ordinarily characterized by its accessibility, such information is often forgotten, lost or misplaced as "layers" are rearranged, particularly in situations involving large or varied amounts of information in relation to the available work space. Also, when a horizontal surface is used in this manner, workers are deprived of space that might be put to better use as an actual worksurface instead of as a storage space for information of lower precedence. The use of a horizontal surface in this manner is inconsistent with the dynamic work environment, where information is ideally used, displayed and stored in a highly efficient manner, and where work surfaces may be shared by more than one worker (each of whom may require or desire access to entirely different sets of information).

Hanging display panel systems represent an attempt to achieve the advantages of prominence and accessibility, not achieved either by use of fixed walls or worksurfaces. However, hanging display panel systems do not fully achieve optimum "information persistence" attributes particularly in situations involving large or varied amounts of information in relation to the available work space. Hanging display panel systems attempt to provide a less permanent, but prominent, vertical surface on which to display information, in a work area. Hanging display panel systems have been developed to display information in various formats utilizing individual panels that are portable and can be displayed in layered or other arrangements. At times, these configurations can include arrangements that provide a degree of reconfigurable space division and the mobile display panels do allow information to be refreshed or interchanged. But the mobility of display panels in such systems makes them difficult to "manage" for either an organized framework for providing the optimum degree of information persistence or utilizing the boards for effective space division. Indeed, while such systems may include a wide variety of mounting structures, such as carts, overhead beams or other structures that allow a wide variety of configurations, none provide an optimum framework for such management.

Accordingly, it would be advantageous to provide for an information display system for use in a work environment that facilitates the efficient use, display and storage of information in the work environment. It would also be advantageous to provide for an information display system that more effectively facilitates "information persistence"—the collection and retention of information meaningful to an individual or group—so that information is readily available and can be "revealed" when needed and yet can be "concealed" and conveniently stowed away securely when not needed. It would further be advantageous to have an information display system that facilitates the management and use of information on vertical surfaces, providing an abundance of display surfaces while occupying a minimal amount of work space. It would further be advantageous to have an information display system that provides an organizational scheme for separating, identifying and linking related but distinct fields of displayed information. It would further be advantageous to provide for a workstation using the information display system and associated structures in order to create work areas that can be readily configured and reconfigured for use by individual workers, small groups of workers and large groups of workers. It would further be advantageous to provide for a work environment including the information display system so that workstations and work areas can dynamically be configured and reconfigured. It would further be advantageous to have an information display system for use in a work environment that allows the efficient and complete transformation of the visual context of a work space or workstation during transitions between projects, tasks and personal respites in the course of a work day or work week. It would further be advantageous to have an information display system for use in a work environment providing for an arrangement and proportion of display boards that evoke a spatial sensation or envelopment and immersiveness for an individual or small group viewing the information. It would further be advantageous to have an information display system that may be removably installed on mounting structures such as panel walls or other articles of furniture within a work environment, and within which display boards or other information containing structures may selectively and conveniently be installed or removed.

It would be highly desirable to provide for an information display system incorporating any one or more of these advantageous features.

SUMMARY OF THE INVENTION

The present invention relates to an information display system having a base assembly adapted for selective removable coupling to a mounting structure and at least one container adapted for coupling to the base assembly.

The present invention also relates to an information display system having a base assembly adapted for coupling to a mounting structure and at least one container adapted for selective removable coupling to the base assembly. Each container is also adapted for pivotal movement and translating movement with respect to the mounting structure.

DESCRIPTION OF THE FIGURES

FIG. 3 is a side elevation view of the information display system (also showing interconnection to a mounting structure) taken along line 3—3 in FIG. 1.

FIG. 4A is a perspective view of a mounting assembly of the information display system.

FIG. 4B is an exploded perspective view of the base assembly and the mounting assembly of the information display system.

FIG. 6A is a fragmentary perspective view of a support bracket for the information display system.

FIG. 6B is a fragmentary perspective view of a support bracket for an information display system according to an alternative embodiment.

DETAILED DESCRIPTION OF THE PREFERRED EMBODIMENTS

Referring to the FIGURES, an information display system is shown for use in a work environment that may include one or more workstations according to preferred and other exemplary embodiments of the present invention. For purposes of any exemplary or alternative embodiments of the present invention, the work environment may be of any type generally providing a work space for one or more workers. The work space may be divided or otherwise arranged to provide one or more work areas for use by the workers, who may be engaged in any of a wide variety of individual activities or group activities, for example, as may be performed by members of a project team or department. Workstations may be configured within the work environment by including one or more articles of furniture within the work areas in support of the workers and their activities. As indicated in the FIGURES, the information display system may be adapted for use within the work environment or included workstations in a wide variety of arrangements, each intended to support individual or collaborative activities of one or more workers, for example, by facilitating the efficient creation, use and storage of information or the configuration and reconfiguration of work areas for the activities.

According to a particularly preferred embodiment, the work environment will be defined at least partially by architectural walls and/or a system of panel walls, such as partial height partitions, any of which may provide a mounting structure for the information display system. The work environment and associated workstations may be arranged to include any of a wide variety of articles of furniture and other associated elements, including additional panel walls configured in any of a wide variety of orientations, chairs or other seating products, storage or casegoods products, tables and other worksurfaces, lighting products or systems, as well as other accessories, electronic or computing equipment and other systems (with associated connectivity such as cabling) known and used in the work environment.

Figure 1:
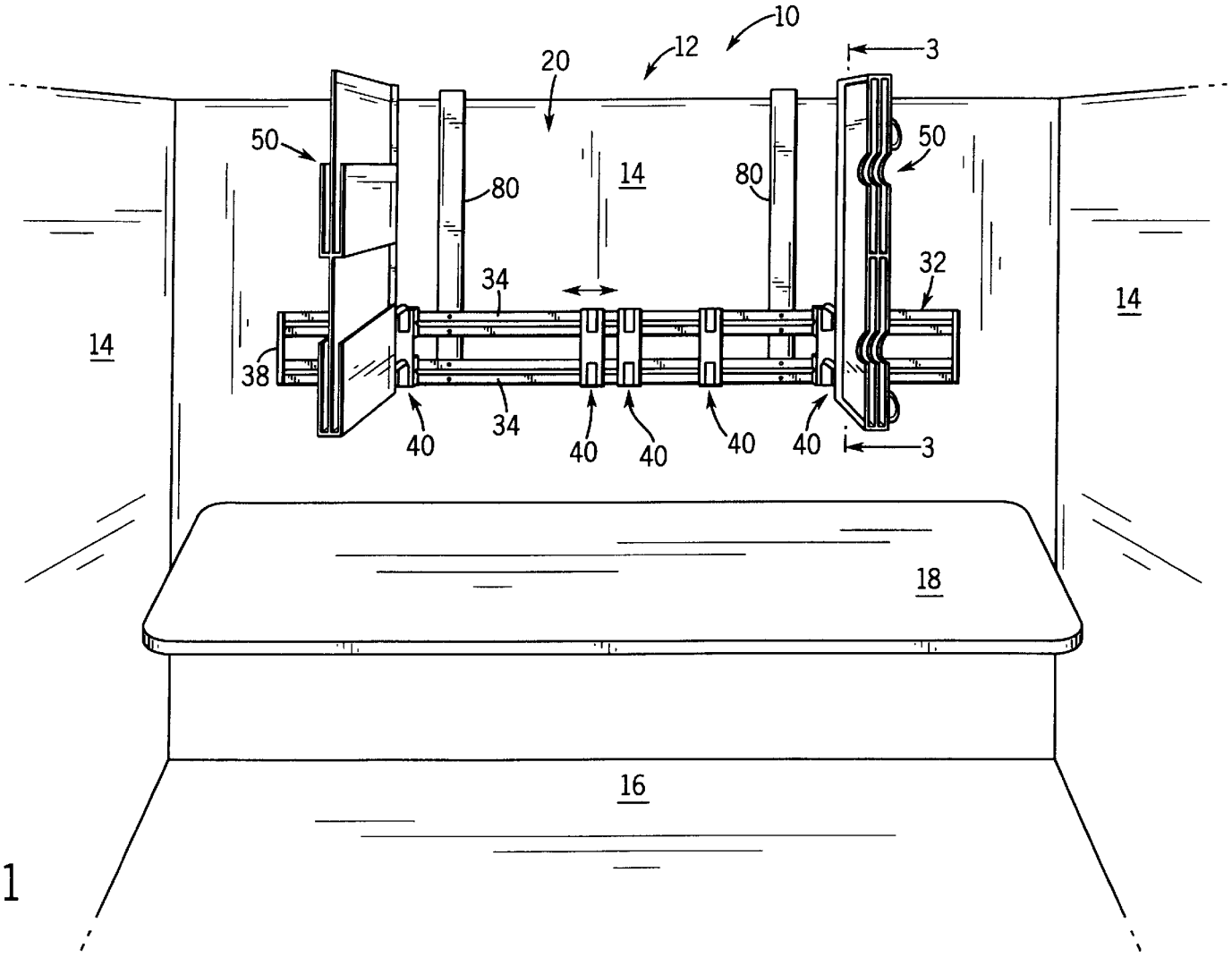
FIG. 1 is a perspective view of a workstation including an information display system coupled to a mounting structure according to an exemplary embodiment of the present invention.
Figure 2:
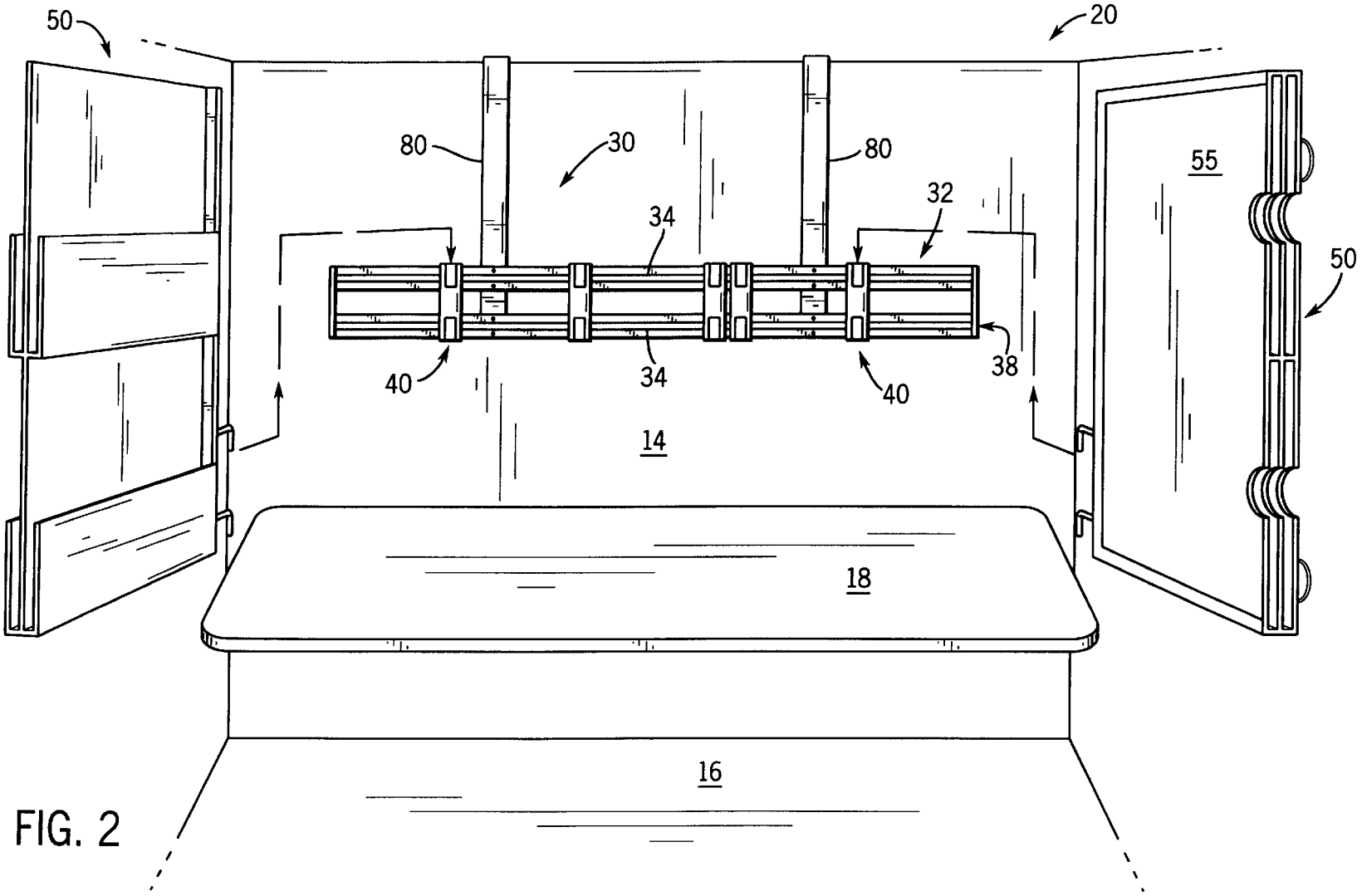
FIG. 2 is a partially exploded perspective view of the information display system of FIG. 1.

Referring to FIGS. 1 and 2, a work environment 10 providing a work space is shown according to an exemplary embodiment of the present invention. A workstation 12 is provided within the work space formed by vertical panel wall sections 14 (each panel wall section standing on a floor 16); a worksurface 18 extends from center panel wall section 14. An information display system 20 is also shown installed on a mounting structure (shown as panel wall section 14 in FIGS. 1 and 2) within workstation 12.

Figure 3A:
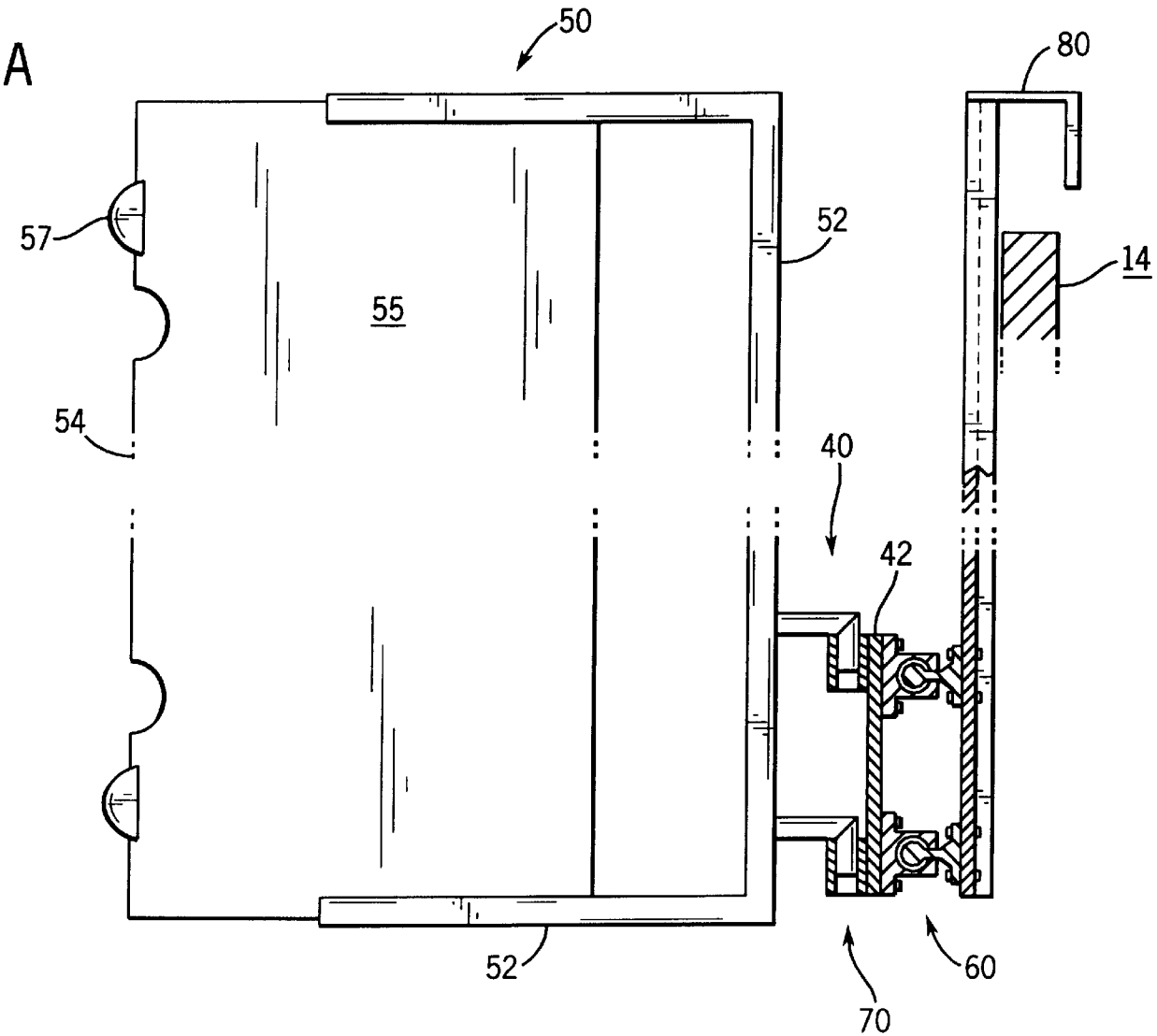
FIG. 3A is a side elevation view of the information display system according to an alternative embodiment.

Information display system 20 includes a base assembly 30 (shown more clearly in FIG. 2) having a track mounting assembly shown as a set of support brackets 80 configured for coupling (e.g. hanging) on panel wall 14. As shown in FIGS. 1 through 3A, base assembly 30 of information display system 20 also includes a track system shown as a rail assembly 32 providing a set of horizontal rails (or shafts) 34. According to a particularly preferred embodiment, a set of mounting plates 36 (associated with rail or shaft 34) is provided by rail assembly 32 for mounting to support brackets 80 (by fasteners shown as bolts 100, see FIG. 4A). According to any preferred embodiment, the base assembly of the information display system is adapted for selective removable coupling to the mounting structure. For example, according to an exemplary embodiment as shown in FIGS. 3 and 3A, base assembly 30 is shown hanging from (in FIG. 3) and removed from (in FIG. 3A) panel wall section 14 by support brackets 80, which is intended to indicate that the base assembly is portable and "non-invasive" and configured to be quickly and easily installed or removed from the mounting structure (e.g. by an office worker).

According to a preferred embodiment, each support bracket 80 of base assembly 30 includes a base frame 82 joined to a top bracket 83 (e.g. a top frame piece 85 and a hook frame piece 86, see FIG. 6A). As shown in FIGS. 1 through 3A, top frame 85 of support bracket 80 rests on the top of panel wall section 14 (or other article of furniture, see FIG. 7), which provides the mounting structure for base assembly 30. Top bracket 83 with base frame 82 of support bracket 80 together serve to secure or retain support bracket 80 by fitting onto panel wall section 14 (see e.g. FIGS. 3 and 3A). According to an alternative embodiment shown in FIG. 6B, a support bracket 80*a* may include a base frame 82*a* and an adjustable top bracket assembly 83*a* (with a top frame 85*a* and a hook frame 86*a* which are separate elements and may be coupled in an adjustable arrangement). Top frame 85*a* includes an adjustment slot 87*a* for interfacing with base frame 82*a* (which has a corresponding hole 88*a*) and an adjustment slot 87*a* for interfacing with hook frame 86*a* (which has a corresponding hole 88*a*); top frame 85*a* is secured and tightened to base frame 82*a* through a bolt 100 and wing nut 102 and to hook frame 86*a* through bolt 100 and a wing nut 102. By selective positional arrangement (or adjustment) of base frame 82*a* and hook frame 86*a* with respect to top frame 85*a*, both the relative vertical position of the track system (e.g. rail assembly, not shown in FIG. 6) and the width of support bracket 80*a* for "fit" or engagement with the mounting structure (e.g. panel wall or other article of furniture, not shown) can be adjusted at the base assembly, so that a secure, non-invasive coupling may be established.

According to preferred and other alternative embodiments, the base assembly (i.e. with track mounting assembly) may be given any of a wide variety of configurations which may facilitate the selective removable and/or adjustable coupling of the base assembly to various types of mounting structures. The base assembly may be coupled to the mounting structure in any of a wide variety of arrangements (e.g. hung, engaged, leaned, attached, suspended, etc.), preferably without the need for external fasteners (but which nonetheless may be used if suitable for a given application). Any one or more articles of furniture may provide a mounting structure for the information display system.

Figure 7:
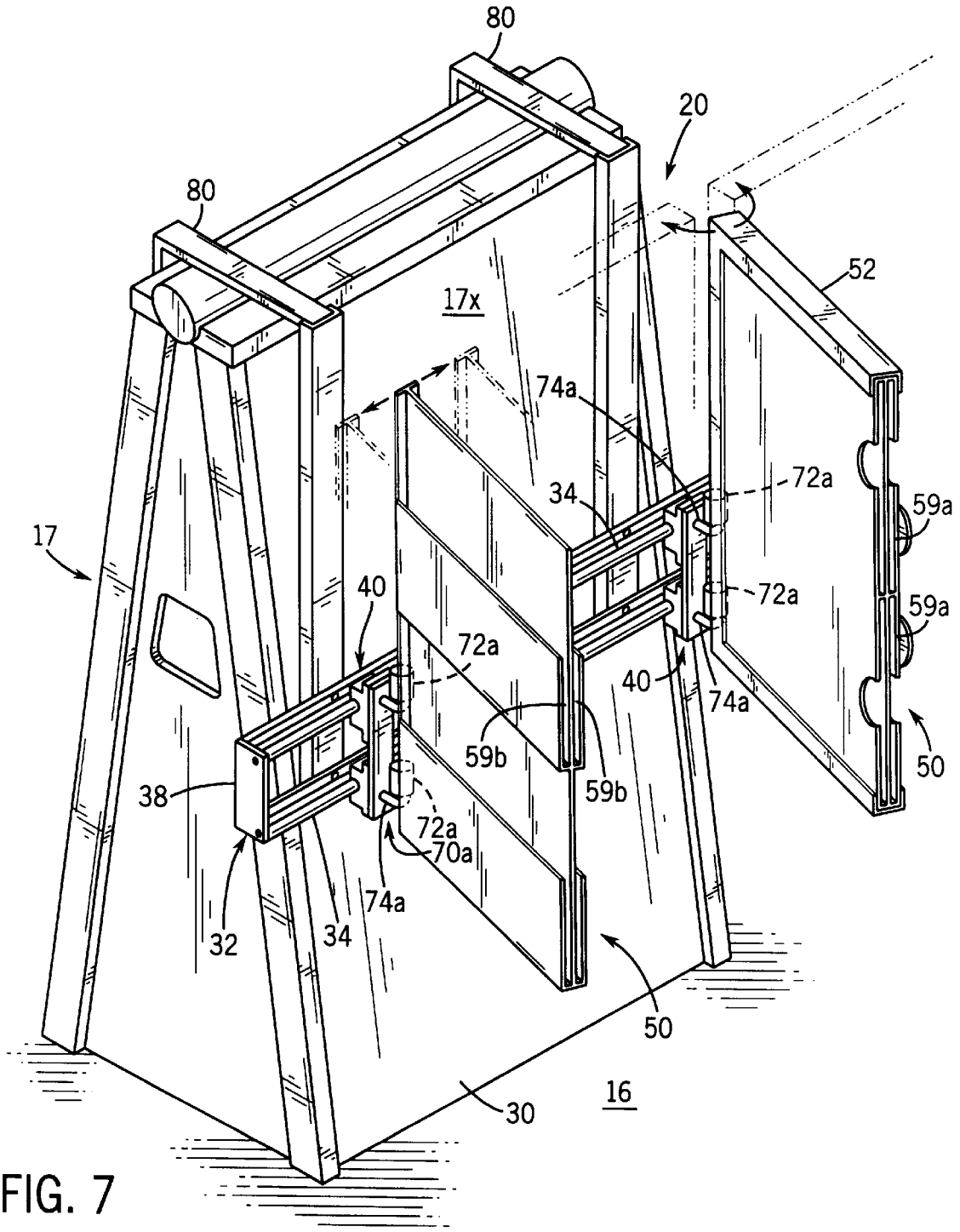
FIG. 7 is a perspective view of an article of furniture with an information display system couple to an article of furniture according to an alternative exemplary embodiment.

According to any preferred embodiment, the information display system will be configured for use and compatibility with a wide variety of information containing structures shown as containers 50 (e.g. carriers), which may be provided in a wide variety of shapes, sizes and purposes, as well as a wide variety of constructions and arrangements (typically though not necessarily with orthogonal display panels), configured to contain and/or present information or materials. FIGS. 1 through 3A and 7 show the construction of containers 50 of the information display system according to preferred and other exemplary embodiments. Referring to FIG. 3, container 50 is shown according to a preferred embodiment, of a type having a frame 52 and an exterior set of display panels 54 (one is shown) with a surface treatment 55 (e.g. for a writable-erasable marking). Referring to FIG. 3A, container 50 is shown according to an alternative embodiment of a type wherein display panel 54 is adapted for selective removable coupling to container 50 (e.g. slidably retained in slots or grooves in frame 52) and accessible by a handle tab 57 for insertion/removal (partially shown in FIG. 3A). As shown in FIGS. 1 and 7, container 50 may include internal compartments 59*a* for holding material (such as documents, supplies, etc.) or external folders 59*b*. According to alternative embodiments, any of a wide variety of display panels or display board carriers or mounting interfaces can be provided by the container, facilitating the use of one or more display boards or display panels in a variety of sizes and orientations (e.g. in portrait mode or landscape mode).

In FIGS. 3 and 4B, a container mounting assembly 40 through which containers 50 are adapted for selective removable coupling to base assembly 30 is shown. Container mounting assembly 40 includes both a mechanism configured to allow for independent translating movement of a container with respect to the mounting structure along horizontal rails 34 (shown as a slide mechanism 60) and a mechanism configured to allow for independent pivoting movement of the container with respect to the mounting structure (shown as a pivot mechanism 70).

Referring to FIGS. 4A and 4B, according to a particularly preferred embodiment, slide mechanism 60 of container mounting assembly 40 is installed upon a base plate 42 (shared with pivot mechanism 70). Slide mechanism 60 includes a set of linear bearings 62 mounted to base plate 42 by fasteners (shown as bolts 100 with nuts 101). Each linear bearing 62 includes a pillow block 64 providing a bearing seat 66 and a self-aligning bearing 68. To install slide mechanism 60 onto rail assembly 32, each self-aligning bearing 68 of container mounting assembly 40 is fitted onto a corresponding rail 34 of rail assembly 32. Through slide mechanism 60, container mounting assembly 40 is slidably coupled to base assembly 30 for translating movement. The range of translating movement of the container along the track system may be determined by the length of the track system, proximity of other containers, and/or the position of a physical stop (shown as an end piece 38 mounted at the ends of rail assembly 32 in FIGS. 1, 2 and 7, or alternatively a pin or other device installed on the rail assembly to arrest or halt the travel of the slide mechanism). As shown in FIGS. 1 and 2, one or two or more slide mechanisms (adapted for carrying associated containers) may be installed on the rail assembly.

The information display system may include a track system having a single track (rail or shaft) or more than two tracks (rails or shafts) located at any suitable distance or spacing (e.g. as may be called for by weight and loading, stability and/or cost considerations). The track system (e.g. rails of the rail assembly) may be installed at a variety of heights or positions with respect to the track mounting assembly (preferably at a height where corresponding containers are free to move suitably above a worksurface). According to alternative embodiments, the track system may be configured to provide rails installed on separate tiers (spaced at horizontal or vertical distances), or in multiple sets, or other groups, sizes, or arrangements, depending upon the needs of a particular application or configuration of a particular embodiment of the information display system. According to any preferred embodiment, the length of the track system may be varied (typically, but not necessarily, in a range from 1 foot to 8 feet) as called for by the needs of an application or "fit" for a workstation or work area (e.g. the number of containers and/or for enhanced portability). The slide mechanism may be any of a variety of shapes and sizes or otherwise use materials suitable to facilitate the engagement or interface with the track system. According to a particularly preferred embodiment, the slide mechanism (e.g. linear bearing) and the rail assembly are of a type commercially available from the McMaster-Carr Supply Company of Elmhurst, Ill. (for example, 48 inches in length and 0.5 inch outer diameter shaft/rail assembly, part no. 59585K53; 1.5 inch length open pillow-block self-aligning bearing, part no. 6255K53), or the like. According to an alternative embodiment, the track system may be provided with ball detents that give tactile or audible feedback and a slight holding force when in contact with the linear bearing; the track system may also be given visual indicia that indicate distances of travel or position of the container along the rail.

While the FIGURES show information display system 20 according to an exemplary embodiment with a track system including a pair of horizontal rails 34 (round) engaged by corresponding linear bearings 62, it should be recognized that many other variations are possible, according to alternative embodiments. The track (rail or shaft) with corresponding engaging device (slide mechanism) may be provided in any of a wide variety of shapes. According to other alternative embodiments, translating motion of containers with respect to a mounting structure may be facilitated by any of a variety of other mechanisms, sliding or rolling, such as rotating wheels traveling in a groove, etc., capable of supporting the containers (not necessarily a linear bearing/rail arrangement). The track system and slide mechanism arrangement may be provided by glide blocks, plastic (or acetal, TFE, self-lubricating) members, clips, or other rolling, sliding, or otherwise translating devices (having any suitable shape or profile), suitable for performance and cost constraints.

Figure 5A:
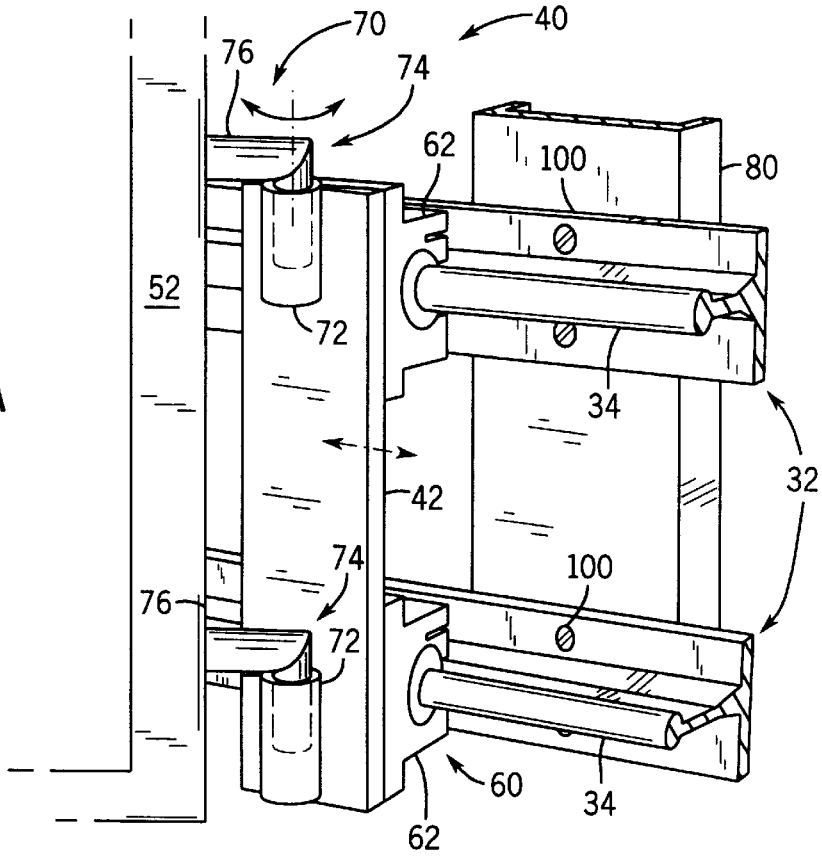
FIG. 5A is a fragmentary perspective view of a carrier with the slide assembly and the rail assembly mounted on a support bracket of the information display system.
Figure 5B:
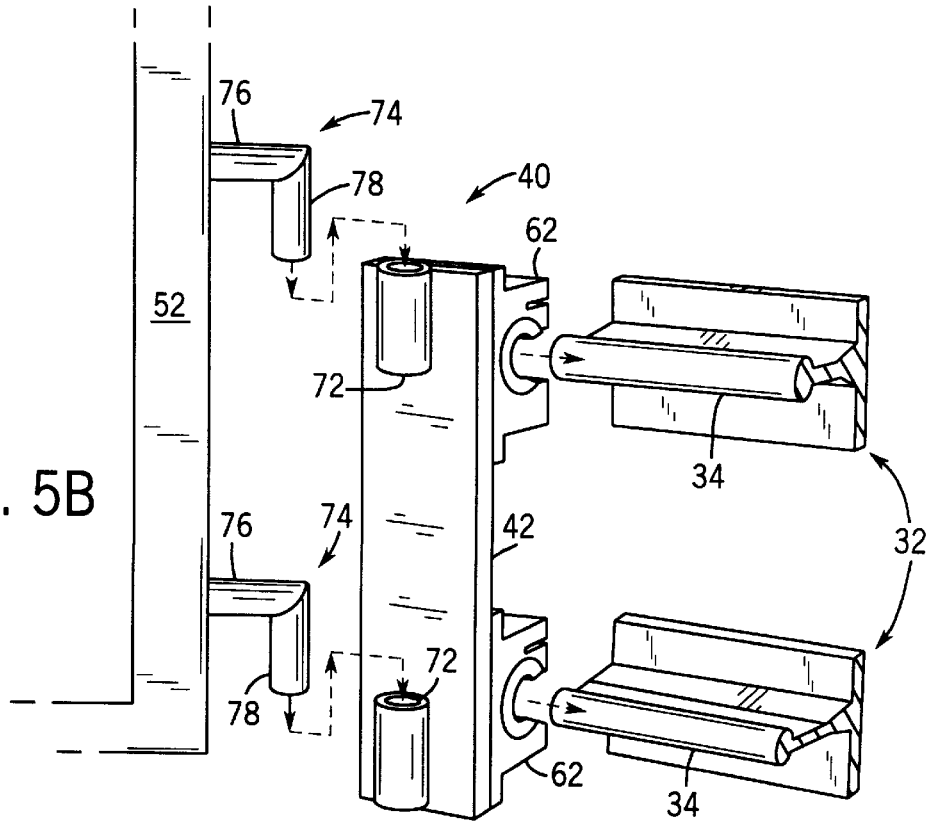
FIG. 5B is an exploded fragmentary perspective view of the of the information display system

Referring to FIGS. 5A and 5B, according to a particularly preferred embodiment, pivot mechanism 70 of container mounting assembly 40 is installed upon base plate 42 (shared with slide mechanism 60). Pivot mechanism 70 includes a set of vertical tubes 72 mounted to base plate 42; projecting from frame 52 of container 50 is a set of hooks 74 (including an arm 76 and a vertical peg 78). Container 50 is securely and pivotally mounted (e.g. hinged) to container mounting assembly 40 by insertion of peg 78 of each hook 74 into corresponding tube 72 so that peg 78 may pivot within corresponding tube 72 and thus container 50 may pivot with respect to base assembly 30 (and the mounting structure). According to alternative embodiments, the hook and tube arrangement may be reversed (so that hook 74*a* is associated with the base plate and tube 72*a* is associated with the container, see for example FIG. 7), or any of a wide variety of other pivot mechanisms that will be known to those who review this disclosure may be used. According to other alternative embodiments, the pivot mechanism may be configured so that two (or more) containers may be pivotally coupled at one container mounting assembly (e.g. by attachment of two or more sets of tubes or hooks to one base plate). The range of pivoting movement of the container with respect to the mounting structure may be determined by the physical arrangement of the track system (or containers) and/or the proximity of other containers. According to any preferred embodiment, the pivot mechanism will not only allow pivoting motion of the container but will also allow each container to be selectively removable (quickly and easily) from the mounting assembly (and base assembly) by an office worker (e.g. by disengagement of the hook, peg and the tube).

Figure 8A:
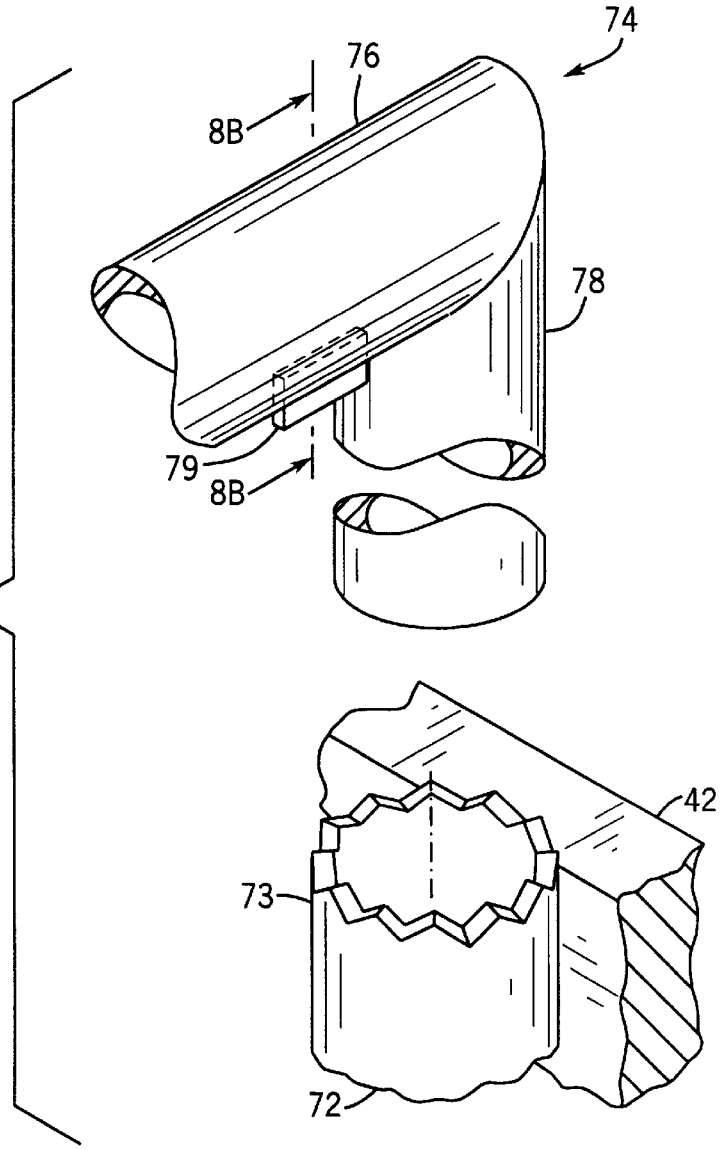
FIG. 8A is a fragmentary perspective view of a mounting arrangement for a container of an information display system according to an alternative embodiment.
Figure 8B:
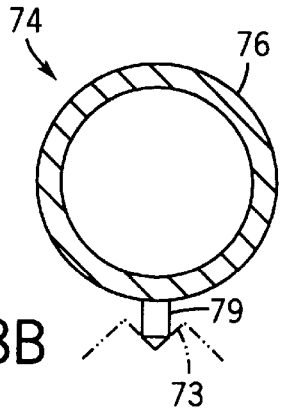
FIG. 8B is a front sectional view of the mounting arrangement for the container of the information display system taken along line 8B–8B in FIG. 8A.

As shown in FIGS. 8A and 8B, the container mounting assembly 40 may be provided with discrete adjustment positions shown as a detent or indexing arrangement shown as a combination of tab 79 provided on hook 74 and serrations providing notches 73 (spaced at fixed degree intervals) in the upper perimeter of tube 72 for "indexing" pivotal movement of the container with respect to the container mounting assembly. The container mounting assembly may also include a mechanism that can be engaged to hold or "lock" a container in a particular pivotal position. The path of pivot movement for each container may end with a physical stop when each container has been pivoted to a certain designated position; the detent or indexing arrangement may also be given a shape to provide a tactile "stop" or "pause" (e.g. a slight holding force) and/or audible feedback when the container has been pivoted to other certain designated positions.

It is important to note that the mounting structure for the information display system may be any of a wide variety of structures, including any of a variety of articles of furniture, such as a space frame system of vertical posts and horizontal beams to which the track system can be attached, or a desk and/or binder bin (storage unit), floor stand or rack, etc. For example, referring to FIG. 7, a mounting structure in the form of an article of furniture shown as an easel 17 is provided for installation of information display system 20. Base assembly 30 of information display system 20 is coupled to easel 17 by track mounting assembly (e.g. support bracket 80 which is used as a hanger). Containers 50 of information display system 20 are coupled through container mounting assembly 40 to a set of rails 34 of rail assembly 32 (e.g. of a type shown in FIG. 1). Easel 17 also includes a display surface 17*x* (e.g. display board).

As indicated in the FIGURES, the containers of the information display system provide for the display of information in a space-efficient, vertical orientation. As a result, by installation of the information display system, the total vertically-oriented and prominent space available for display of information within a work environment can be increased in comparison to conventional work environments that do not include the information display system. As shown in the FIGURES, and according to any preferred embodiment, installation of the information display system will increase the amount of information that can be presented for display within a work environment given an otherwise fixed amount of wall space or vertical surface area. Thus, installation of the information display system will also serve to facilitate the management of a comparatively large volume of information for access, display and storage in a given work environment.

Information presented on or by the containers (e.g. contained on display panels) may selectively be revealed or concealed, for example, by selective arrangement of the relative positions of the containers with respect to other containers or associated articles of furniture or by selective arrangement of the pivotal condition of the containers (relative to office workers). As is evident, according to any preferred embodiment, information contained on an exterior (display) surface of a display panel associated with a container is ordinarily revealed and visible, but may be concealed when that container is positioned closely adjacent to another container (or when positioned in a suitable area or closely adjacent to a wall or other article of furniture). (A container or display panel may include or be made up of one or more display boards, typically selectively removable boards or sheets that contain information intended for display or to which information may be applied.)

According to any preferred embodiment, the information display system and its associated selectively removable elements (e.g. containers, display panels and base assembly) can readily (quickly and easily) be installed, removed, or otherwise arranged to configure or reconfigure one or more workstations or work areas of varying sizes or requirements within the work space given in a work environment. By selective arrangement of the base assembly or of the containers (and/or display panels) and other associated articles of furniture, the information display system can be configured to support one or more workers in individual or group activities.

Both the territorial appearance (i.e. arrangement) and contextual appearance of the work environment and associated workstations can be readily and easily configured and reconfigured by arrangement of basic elements of the information display system. Space division, or "territorial" reconfiguration of work spaces and work areas, will not require rearrangement of any "fixed" elements, such as panel walls and other articles of furniture that are generally considered to be "fixed" once installed in the work environment insofar as substantial effort (e.g. disassembly, lifting, etc.) or tools are required for movement. Visual modification, or "contextual" reconfiguration of work spaces and work areas of varying sizes can likewise be effected without rearrangement of any "fixed" elements within the work environment or needing to independently handle detached containers. According to any preferred embodiment, following initial installation of the "fixed" articles of furniture and of the information display system and associated elements within the work environment, the individual worker or workers may selectively configure or reconfigure the work space into one or more work areas and workstations, by installation of the base assembly and the containers, as needed to support their activity or activities.

Installation of the information display system allows for several "methods" of selective transformation of physical space and visual effect within a work space including at least the following: (1) division of physical space and/or alteration of visual effect by installation, adjustment, removal, or relocation of the information display system; (2) division of physical space and/or alteration of visual effect by movement of containers (e.g. in association with other containers and/or articles of furniture); (3) division of physical space and/or alteration of visual effect by removal and replacement or interchange of containers; (4) division of physical space and/or alteration of visual effect by opening or closing containers to reveal and conceal information; (5) alteration of visual effect by removal and replacement, or interchange, of display panels associated with a container; and (6) alteration of visual effect by revising the content of information (e.g. rewriting, erasing, posting) on display boards associated with a container. As a result, the work environment is capable of flexible and dynamic configuration and reconfiguration to support a wide variety of workers engaged in a wide variety of tasks and activities that may require creation, use and storage of even a large volume of information. (When removed, containers may be stored standing upright and side-by-side in a compact manner, wherein the information remains accessible, for example in a holding area beneath a desk or worksurface, or in another convenient storage unit.)

As is apparent from FIGS. 1, 2 and 7, according to any preferred embodiment, the elements of the information display system are adapted for selective removable coupling or attachment to the mounting structure, in a manner that installation and removal may readily be accomplished by an office worker (preferably without the need for special tools) at various "levels". For example, if the information display system is to be moved from one mounting structure to another mounting structure, an office worker may remove the base assembly of the information display system (i.e. the support bracket with the track system) from the mounting structure and carry it to the other mounting structure, then reinstall it (e.g. by lifting and hanging or otherwise mounting or engaging the support bracket); containers are removable and replaceable (e.g. by lifting or otherwise disengaging) from the container mounting assembly (e.g. hook-tube arrangement); display panels are removable and replaceable (e.g. by sliding or otherwise disengaging) from the frame of the container.

According to any preferred embodiment, the information display system provides an organizational framework intended to promote and advance the efficient use, display and storage of information and layers of information on display panels (e.g., "information persistence," regardless of the format by which the information is placed on associated display boards) in the work environment. According to any preferred embodiment of the information display system, each display panel will include at least one display board adapted to contain or present information. As will become apparent to those of ordinary skill who review this disclosure, the display boards may be provided in any of a wide variety or formats, or may be adapted to display information in any of a wide variety of formats and/or media; a wide variety of configurations are possible for the information display system, employing variations of size, shape, orientation, arrangement, mounting interfaces and structures, etc., as well as variations in the deployment of display boards. According to any preferred embodiment, the information display system will facilitate the dynamic configurability and reconfigurability of work spaces, workstations and work environments, in territorial appearance and contextual appearance (e.g. as scenery or "sets" can be reconfigured in a theatre play).

It is important to note that the construction and arrangement of the elements of the information display system in the exemplary embodiments is illustrative only. Many variations are possible. The support brackets, track system, and other mechanisms may be provided in a variety of shapes, sizes, dimensions, materials and quantities suited for a variety of applications. According to a particularly preferred embodiment, each support bracket of the base assembly (two are used) is framed of "C"-channel steel (2.5 inches by 0.5 inches 20 gauge). The base plate of the container mounting assembly is a steel plate (6 inches by 1.5 inches by 0.25 inches) and the tubes (1.25 inches in length and 0.375 inches in diameter) are welded onto the base plate. The pivot mechanism and/or container mounting assembly may be provided in various other arrangements. According to alternative embodiments (and upon the demands of a particular application) the elements can be made in any of a wide variety of shapes, dimensions and materials (metal and/or plastic). According to a particularly preferred embodiment, the information display system is equipped to include ten containers associated with the track system, but may be equipped for other numbers of containers according to alternative embodiments and applications.

According to alternative embodiments, the information display system can be implemented through a wide variety of mounting arrangements that allow for translating movement of the containers and associated display boards with respect to a wide variety of mounting structures, for example, floors, architectural walls, panel walls, systems furniture, space frames, other articles of furniture, etc. The variety of mounting structures that may be used with the information display system illustrates the flexibility and adaptability of the information display system to a wide variety of work environments. Moreover, although in the exemplary embodiments the container mounting assembly and track system for the containers of the information display system are preferably arranged for linear movement along the mounting structure, according to alternative embodiments, the track system of the information display system may be configured for wholly or partially curved movement (e.g. as necessary to conform to a curved wall or other mounting structure alone or in combination to facilitate the movement of containers from one orientation or plane to another within a work environment). According to an alternative embodiment, the track system may be pivotally or removably coupled to the track mounting assembly so that the base assembly may be folded down or partially disassembled for storage or transport, enhancing the "portability" of the information display system.

It is important to note that the containers and/or display panels (which have to some extent been represented schematically in the FIGURES) may be configured to include display boards or related structures or elements in any of a wide variety of formats beyond those shown and described, all of which also are intended to fall within the scope of the present invention. As will become apparent to those who review this disclosure, according to alternative embodiments, other accessories such as compartments, pouches, tablets, etc. may be installed within or onto a container, or the container may be configured to supply utilities (i.e., voice, power, data, etc.) or "connectivity" to utilities for use in the work area or workstation. According to other alternative embodiments, the information display system may include any of a variety of types of information containing structures (represented schematically by the containers shown in the FIGURES) having a wide variety of constructions and any of a wide variety of associated mechanisms beyond those shown and described, all of which are intended to fall within the scope of the present invention.

It is important to note that the "information display system" is not meant as a term of limitation, insofar as the structures described in this specification (or alternative and/or equivalent structures) may serve other functions, such as carrying and containing material in a wide variety of forms. It is also important to note that the use of the terms "display panel" or "display board" are not meant as terms of limitation, insofar as any "panel" or "board" or like structure having a decorative or functional use or application is intended to be within the scope of the term. For example, the use of the term "display board" is intended as a convenient reference for any such "board" or structure, which may also be viewed synonymously with the term "work board" or other like terms. According to any preferred embodiment, the display panel or display board is configured in a generally symmetrical basic form so that the designation of a "front surface" and "back surface" is essentially arbitrary and dependent upon the orientation within the information display system. Exemplary display boards may be formed of any of a variety or materials or have any of a variety of sizes and shapes, constructions (with any of a variety of properties, such as weight, strength, rigidity, acoustic properties, flammability, etc., suitable for the intended application) and mounting interfaces. As will be apparent to those who review this disclosure, the outer surfaces of the display boards may be provided with a wide variety of surface treatments (e.g. tackable or repositionable adhesive, clear film overlay or "photo album", clear film "pocket", writable clear film, cork or tack board, peg board, magnetic board, marker board, dry erase or "white" board, paper or paper tablet, projection screen, graphics display, cloth, etc.) in a wide variety of combinations (i.e. with one surface differing in whole or in part from the other surface) that may be suited or adapted to a wide variety of functional and decorative purposes according to the preferred and other alternative exemplary embodiments of the present invention. According to any preferred embodiment, the display boards and associated structures and systems are configured for ease and flexibility of use (e.g. recording, mapping, transformation, capture, etc.), display (e.g. sharing and communicating), and storage—information persistence—as well as of mounting and removal from associated mounting structures (such as the containers).

It is also important to note that the use of the term "information" is meant to cover any use of any type of media or any type of representation that can be associated with a container or display board (or display surface or compartment).

Although only a few exemplary embodiments of the present invention have been described in detail in this disclosure, those skilled in the art who review this disclosure will readily appreciate that many modifications are possible in the exemplary embodiments (such as variations in sizes, structures, shapes and proportions of the various elements, values of parameters, mounting arrangements, or use of materials) without materially departing from the novel teachings and advantages of the invention. Accordingly, all such modifications are intended to be included within the scope of the invention as defined in the appended claims. Other substitutions, modifications, changes and omissions may be made in the design, operating conditions and arrangement of the preferred embodiments without departing from the spirit of the invention as expressed in the appended claims.

What is claimed is:

1. A transportable information display system for use in a work environment providing a work space and configured for association with a mounting structure comprising:

a base assembly having a base frame adapted for selective coupling to and removal from the mounting structure;

at least one container adapted for selective removable coupling to the base assembly and also adapted for pivotal movement and translating movement with respect to the mounting structure;

wherein the at least one container is adapted to provide at least one display panel with a surface configured to display information;

so that information is capable of being selectively revealed or concealed at least (a) by installation or removal of the at least one container and (b) by movement of the at least one container with respect to the mounting structure and (c) by installation or removal of the at least one display panel from the at least one container.

2. The information display system of claim 1 wherein the at least one container is positioned at a vertical height sufficient to provide clearance for an article of furniture there below.

3. The information display system of claim 1 further comprising a mounting assembly for coupling the at least one container to the base assembly.

4. The information display system of claim 3 wherein the mounting assembly includes a pivot mechanism with at least one hook.

5. The information display system of claim 4 wherein the pivot mechanism includes at least one tube adapted to be engaged by the at least one hook.

6. The information display system of claim 1 wherein the at least one container is adapted to provide a plurality of display panels.

7. The information display system of claim 1 wherein the base assembly includes a track system and the at least one container is adapted for coupling to the track system.

8. The information display system of claim 7 wherein the track system includes at least one rail.

9. The information display system of claim 7 wherein the track system is substantially linear.

10. The information display system of claim 1 wherein the at least one container provides a compartment for the storage of materials.

11. The information display system of claim 1 wherein a height of the at least one container is selectively adjustable with respect to the mounting structure.

12. The information display system of claim 1 wherein the at least one container is provided with at least one display panel adapted for selective removable coupling to the at least one container.

13. The information display system of claim 1 wherein the at least one container includes a carrier.

14. The information display system of claim 1 wherein the base assembly includes a mounting interface for engaging the mounting structure selected from the group consisting of hooks, brackets, noninvasive couplings and combinations thereof.

15. The information display system of claim 14 wherein the mounting interface of the base assembly is adapted to engage the mounting structure without the use of a fastener.

16. The information display system of claim 15 wherein the mounting interface includes a base and a lateral tab having a surface extending from the base.

17. The information display system of claim 1 wherein when the at least one container is in a first orientation the work space is divided into a first work area and a second work area and when the at least one container is in a second orientation the work space is undivided.

18. The information display system of claim 1 wherein the at least one container includes a carrier.

19. The information display system of claim 1 wherein the base assembly is configured to be quickly and easily removable from the mounting structure.

20. The information display system of claim 1 wherein the at least one container is configured to be quickly and easily removable from the base assembly.

21. A transportable information display system for use in a work environment and configured for association with a mounting structure within a work space comprising:

a base assembly providing a track system and adapted for selective removable coupling to the mounting structure so that the work space can be reconfigured by installation or removal of the base assembly from the mounting structure;

at least one container adapted for selective removable coupling to the track system;

wherein the at least one container is adapted to provide at least one display panel including a first surface and a second surface each configured to display information and is also adapted for pivotal movement through a first range of motion and translating movement through a second range of motion with respect to the mounting structure;

so that information is capable of being selectively revealed or concealed at least (a) by installation or removal of the at least one container and (b) by movement of the at least one container through the first range of motion or the second range of motion with respect to the mounting structure and (c) by installation or removal of the at least one display panel from the at least one container.

22. The information display system of claim 21 further comprising at least one mounting assembly adapted to be engaged by the track system and adapted for coupling to the at least one container.

23. The information display system of claim 22 wherein the at least one mounting assembly includes a slide mechanism and at least one pivot mechanism.

24. The information display system of claim 21 wherein the at least one container is provided with at least one display panel having a surface with a surface treatment, the at least one display panel being adapted to reveal or conceal information upon the surface treatment.

25. The information display system of claim 21 wherein the first range of motion is constrained by the track system.

26. The information display system of claim 21 wherein the track system comprises an upper track and a lower track.

27. The information display system of claim 21 wherein the at least one container is provided with at least one display panel adapted for selective removable coupling to the at least one container.

28. The information display system of claim 21 wherein the container is adapted for pivotal movement so that either of the first surface or the second surface of the display panel may be pivoted substantially parallel to the mounting structure.

29. The information display system of claim 28 wherein the first range of motion includes at least one discrete adjustment position.

30. The information display system of claim 21 wherein the second range of motion is approximately equal to a length of the track system.

31. The information display system of claim 21 wherein the first range of motion is approximately 180 degrees relative to the mounting structure.

32. The information display system of claim 21 wherein the first range of motion is at least approximately 135 degrees.

33. The information display system of claim 21 wherein the base assembly is configured to be quickly and easily removable from the mounting structure.

34. The information display system of claim 21 wherein the at least one container is configured to be quickly and easily removable from the base assembly.

35. A transportable information display system configured for association with a mounting structure and for use by a worker within a work space comprising:

a base assembly providing a track system and adapted for selective removable noninvasive coupling to the mounting structure so that the work space can be selectively reconfigured by installation or removal of the base assembly from the mounting structure;

at least one container adapted for coupling to the track system and for movement to provide a plurality of orientations with respect to the mounting structure;

wherein the at least one container is adapted for pivotal movement and translating movement with respect to the mounting structure so that when the at least one container is in a first orientation the work space is divided into a first work area and a second work area and when the at least one container is in a second orientation the work space is undivided.

36. The information display system of claim 35 wherein the base assembly is suspended from the mounting structure.

37. The information display system of claim 35 wherein the base assembly includes a bracket.

38. The information display system of claim 35 wherein a territorial appearance of the work space can be quickly and easily selectively reconfigured by installation or removal of the base assembly from the mounting structure.

39. The information display system of claim 35 further comprising at least one mounting assembly adapted for coupling to the base assembly and wherein the at least one container is adapted for coupling to the at least one mounting assembly.

40. The information display system of claim 35 wherein the base assembly is configured to be quickly and easily removable from the mounting structure.

41. The information display system of claim 35 wherein the at least one container is configured to be quickly and easily removable from the base assembly.

42. The information display system of claim 35 wherein the base assembly includes a mounting interface for engaging the mounting structure selected from the group consisting of hooks, brackets, noninvasive couplings, and combinations thereof.

43. The information display system of claim 42 wherein the mounting interface of the base assembly is adapted to engage the mounting structure without the use of a fastener.

44. The information display system of claim 43 wherein the base assembly is suspended from the mounting structure.

45. The information display system of claim 43 wherein the base assembly rests upon the mounting structure.

46. The information display system of claim 43 wherein the track system is linear.

47. The information display system of claim 43 wherein the base assembly includes at least one hook.

48. The information display system of claim 43 wherein the base assembly is adjustably coupled to the mounting structure.

49. The information display system of claim 43 wherein the at least one container includes a carrier.

50. The information display system of claim 49 wherein the at least one container comprises at least one display panel.

51. The information display system of claim 49 wherein the at least one container is adapted for selective removable coupling to the base assembly without the removal of another container.

52. The information display system of claim 51 wherein the at least one display panel is adapted for selective removable coupling to the at least one container so that information contained on the at least one display panel may selectively be revealed by coupling the at least one display panel to the at least one container or concealed by removing the at least one display panel from the at least one container.

53. The information display system of claim 42 wherein the mounting interface includes a base and a lateral tab having a surface extending from the base.

54. A transportable information display system configured for association with a mounting structure and for use by a worker within a work space comprising:

a base assembly configured for non-invasive coupling to the mounting structure and providing a track system and adapted for selective removable coupling to the mounting structure;

at least one container adapted for coupling to the track system and for movement to provide a plurality of orientations with respect to the mounting structure and adapted for pivotal movement and translating movement with respect to the mounting structure so that when the at least one container is in a first orientation the work space is divided into a first work area and a second work area and when the at least one container is in a second orientation the work space is undivided;

wherein a territorial appearance of the work space can be selectively reconfigured by installation or removal of the base assembly from the mounting structure.

55. The information display system of claim 54 wherein the base assembly is configured to be quickly and easily removable from the mounting structure.

56. The information display system of claim 54 wherein the at least one container is configured to be quickly and easily removable from the base assembly.

57. The information display system of claim 54 further comprising a partial height wall.

58. The information display system of claim 54 wherein the work space can be quickly and easily selectively reconfigured.

59. The information display system of claim 58 wherein the territorial appearance of the work space can be quickly and easily selectively reconfigured by installation or removal of the at least one container.

60. The information display system of claim 59 wherein the territorial appearance of the work space can be quickly and easily selectively reconfigured by positional adjustment of the at least one container.

61. The information display system of claim 60 wherein the territorial appearance of the work space can be quickly and easily selectively reconfigured by replacement of the at least one container.

62. The information display system of claim 60 wherein the territorial appearance of the work space can be quickly and easily selectively reconfigured by the opening of at least one container.

63. The information display system of claim 54 further comprising at least one mounting assembly adapted for coupling to the base assembly and wherein the at least one container is adapted for coupling to the at least one mounting assembly.

64. The information display system of claim 54 wherein the base assembly is suspended from the mounting structure.

65. The information display system of claim 64 wherein the base assembly includes at least one support bracket.

66. The information display system of claim 54 wherein the base assembly rests upon the mounting structure.

67. The information display system of claim 54 wherein the track system is linear.

68. The information display system of claim 67 wherein the track system includes at least one rail.

69. The information display system of claim 54 wherein the base assembly is adjustably coupled to the mounting structure.

70. The information display system of claim 54 wherein the at least one container includes a carrier.

71. The information display system of claim 70 wherein the at least one container comprises at least one display panel.

72. The information display system of claim 71 wherein the at least one display panel is adapted for selective removable coupling to the at least one container so that information contained on the at least one display panel may selectively be revealed by coupling the at least one display panel to the at least one container or concealed by removing the at least one display panel from the at least one container.

73. The information display system of claim 70 wherein the at least one container provides a compartment for storage of material.

74. The information display system of claim 70 wherein the at least one container is adapted for selective removable coupling to the base assembly without the removal of another container.

75. The information display system of claim 54 wherein the at least one container is configured to at least partially conceal the worker when in the first orientation to provide an increased relative level of privacy in the work space.

76. The information display system of claim 75 wherein translating movement of the at least one container to the first orientation increases the area of the first work area and decreases the area of the second work area.

77. The information display system of claim 76 wherein the at least one container is in an opened position in the first orientation and the at least one container is in a closed position in the second orientation.

78. The information display system of claim 54 wherein the base assembly includes a frame having a mounting interface adapted for engaging the mounting structure.

79. The information display system of claim 78 wherein the mounting interface includes a base and a lateral tab having a surface extending from the base.

* * * * *